United States Patent [19]

Hoffmann et al.

[11] Patent Number: 4,964,501

[45] Date of Patent: Oct. 23, 1990

[54] APPARATUS FOR TRANSFERRING LAYERS OF ROD-SHAPED ARTICLES IN PACKING MACHINES

[75] Inventors: Gottfried Hoffmann, Schwarzenbek; Reinhard Deutsch, Geesthacht; Horst Symannek, Neubörnsen, all of Fed. Rep. of Germany

[73] Assignee: Körber AG, Hamburg, Fed. Rep. of Germany

[21] Appl. No.: 387,150

[22] Filed: Jul. 28, 1989

[30] Foreign Application Priority Data

Aug. 12, 1988 [DE] Fed. Rep. of Germany ..... 3827432

[51] Int. Cl.[5] ..... B65G 57/00

[52] U.S. Cl. ..... 198/418.3; 414/788.4; 414/794.7; 414/797.9; 53/149; 53/150

[58] Field of Search ..... 198/418.3; 414/788.4, 414/797.9, 794.7; 53/148–151; 131/282, 283

[56] References Cited

U.S. PATENT DOCUMENTS 3,117,667 1/1964 Tichy et al. ..... 198/418.3

4,362,235 12/1982 Erdmann ..... 53/149

4,471,866 9/1984 Erdmann et al. ..... 53/150

4,528,801 7/1985 Seragnoli et al. ..... 53/150

*Primary Examiner*—Joseph E. Valenza

*Attorney, Agent, or Firm*—Peter K. Kontler

[57] ABSTRACT

The lower ends of several ducts which dispense layers of parallel cigarettes are located at different levels adjacent the path of movement of a stepwise advancing chain with receptacles for multi-layer arrays of cigarettes which are to be draped into blanks for conversion into cigarette packs. A discrete endless conveyor is installed between the lower end of each duct and the receptacle which registers with such duct, and each conveyor has one or more pushers serving to transfer layers of cigarettes into the registering receptacles. Each conveyor is driven by a discrete motor, and the conveyors can be started and arrested in a predetermined sequence to ensure that each receptacle which registers with a duct is empty when the apparatus is idle, and that each receptacle which advances beyond the last duct contains a full array of cigarettes.

11 Claims, 2 Drawing Sheets

APPARATUS FOR TRANSFERRING LAYERS OF ROD-SHAPED ARTICLES IN PACKING MACHINES

BACKGROUND OF THE INVENTION

The invention relates to improvements in apparatus for manipulating rod-shaped articles, especially rod-shaped articles of the tobacco processing industry. More particularly, the invention relates to improvements in apparatus which can be used in cigarette packing and like machines to gather blocks or arrays of rod shaped articles which are to be converted into packs by draping them into paper blanks, blanks of metallic foil and/or other types of blanks. Still more particularly, the invention relates to improvements in apparatus for removal and transport of layers of parallel rod-shaped articles which are dispensed from ducts of the type serving to ensure predictable discharge of layers of rod-shaped articles from the magazine of a packing machine.

Blocks or arrays of rod-shaped articles (e.g., filter cigarettes or plain cigarettes) which are to be draped into blanks in a packing machine and contain two or more layers of articles can be formed in a number of different ways. One mode of forming such blocks includes gathering all articles of a block in a duct and transferring a full block from the duct into a suitable receptacle for transport to the draping station. Another mode involves stepwise gathering of blocks in successive receptacles by delivering a first layer or articles into successive receptacles at a first station, by thereupon delivering second layers into successive partially filled receptacles at a second station, and so on, depending on the number of layers in a full block. The last mentioned mode is preferred at this time because it takes much less time to dispense a single layer than a full block, i.e., the output of the block gathering apparatus (and hence of the entire packing machine) can be increased by assembling each multi-layer block in a series of successive steps. Reference may be had to U.S. Pat. No. 4,362,235 to Erdmann and to published German patent application No. 33 12 976. The patent to Erdmann discloses a single expelling element which is reciprocable along its path and is provided with several prongs, one for each layer of a full block. The published German patent application discloses an apparatus wherein each layer is expelled from its duct by a discrete pusher.

Additional apparatus for assembling layers of rod-shaped articles into block-shaped arrays are disclosed in U.S. Pat. Nos. 4,471,866 and 4,503,967 to Erdmann et al.

OBJECTS OF THE INVENTION

An object of the invention is to provide an apparatus which renders it possible to accumulate satisfactory blocks or arrays of rod-shaped articles in a simple and time-saving manner and with a minimum of rejects.

Another object of the invention is to provide the apparatus with novel and improved means for transferring layers of rod-shaped articles from a magazine into the block-accumulating receptacles of a transporting device.

A further object of the invention is to provide an apparatus which invariably accumulates complete blocks or arrays of parallel rod-shaped articles and can be used to gather blocks each of which consists of a single layer or of two or more layers.

An additional object of the invention is to provide novel and improved controls for use in the above outlined apparatus.

Still another object of the invention is to provide the apparatus with novel and improved means for ensuring gentle treatment of sensitive rod-shaped articles (such as plain or filter cigarettes, cigars, cigarillos or cheroots) during expulsion from a magazine as well as during introduction into receptacles.

An additional object of the invention is to provide a novel and improved method of gathering blocks of parallel rod-shaped articles in the form of single layers or in the form of multiple layers which are superimposed upon one another.

SUMMARY OF THE INVENTION

The improved apparatus is used to transfer layers of elongated parallel rod-shaped articles, particularly cigarettes or other rod-shaped articles of the tobacco processing industry. The improved apparatus comprises a magazine including at least one article-containing duct having a lower end which serves to discharge a succession of layers of rod-shaped articles, a transporting device (such as an endless chain conveyor) having a series of receptacles and serving to place successive receptacles of the series into register with the lower end of the at least one duct, and means for transferring layers from the lower end of the at least one duct into registering receptacles of the transporting device. The transferring means comprises at least one endless conveyor and at least one expelling element (e.g., in the form of a pusher) which is provided on the at least one conveyor and is operative to move a layer of articles from the lower end of the at least one duct into the registering receptacle in the longitudinal direction of the articles.

The magazine can comprise a plurality neighboring ducts with lower ends disposed at different levels having a mutual spacing corresponding to the diameter of a rod-shaped article. The transporting device of such apparatus is operative to place a receptacle into register with the lower end of each other duct when a receptacle registers with the lower end of the at least one duct. The transferring means of such apparatus comprises an endless conveyor with at least one expelling element for each duct and preferably a discrete prime mover for each endless conveyor. Each prime mover preferably comprises means for continuously driving the respective endless conveyor. Such transferring means preferably further comprises discrete starting and arresting means for each prime mover and means for operating the starting and arresting means so as to start the conveyors in a predetermined sequence as well as to arrest the conveyors in the same sequence.

The transferring means can comprise a plurality of equidistant expelling elements on each endless conveyor and means for movably coupling the expelling elements to the respective conveyor.

The at least one endless conveyor (and for that matter each conveyor if the transferring means comprises two or more endless conveyors) defines for and moves the at least one expelling element along an endless first path and the transferring means preferably further comprises the aforementioned means for movably coupling the at least one expelling element to the at least one conveyor, and means for imparting to the at least one expelling element a movement along a second path with reference to the at least one endless conveyor in response to movement of the at least one expelling element along the first path. The movement imparting means can comprise a stationary cam which defines the second path and follower means provided on the at least one expelling element and tracking the cam. For example, the cam can be provided with an endless cam groove for the follower means.

The first path includes a predetermined portion along which the at least one expelling element is moved in a predetermined direction by the at least one endless conveyor during transfer of a layer from the lower end of the at least one duct into the registering receptacle, and the cam includes a portion which is tracked by the follower means while the at least one expelling element is moved along the predetermined portion of the first path and which causes the at least one expelling element to move with reference to the at least one endless conveyor counter to the predetermined direction. The coupling means preferably comprises means for pivotably coupling the at least one expelling element to the at least one endless conveyor so that the movements of the at least one expelling element along the second path are pivotal movements.

The first path further includes a second portion which follows the predetermined portion, and the cam includes a second portion which is tracked by the follower means while the at least one expelling element is moved along the second portion of the first path and which causes the at least one expelling element to become disengaged from the freshly transferred layer, preferably by moving to a level beneath the transferred layer. The second portion of the first path is or can be arcuate, and the second portion of the second path is or can be substantially straight.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
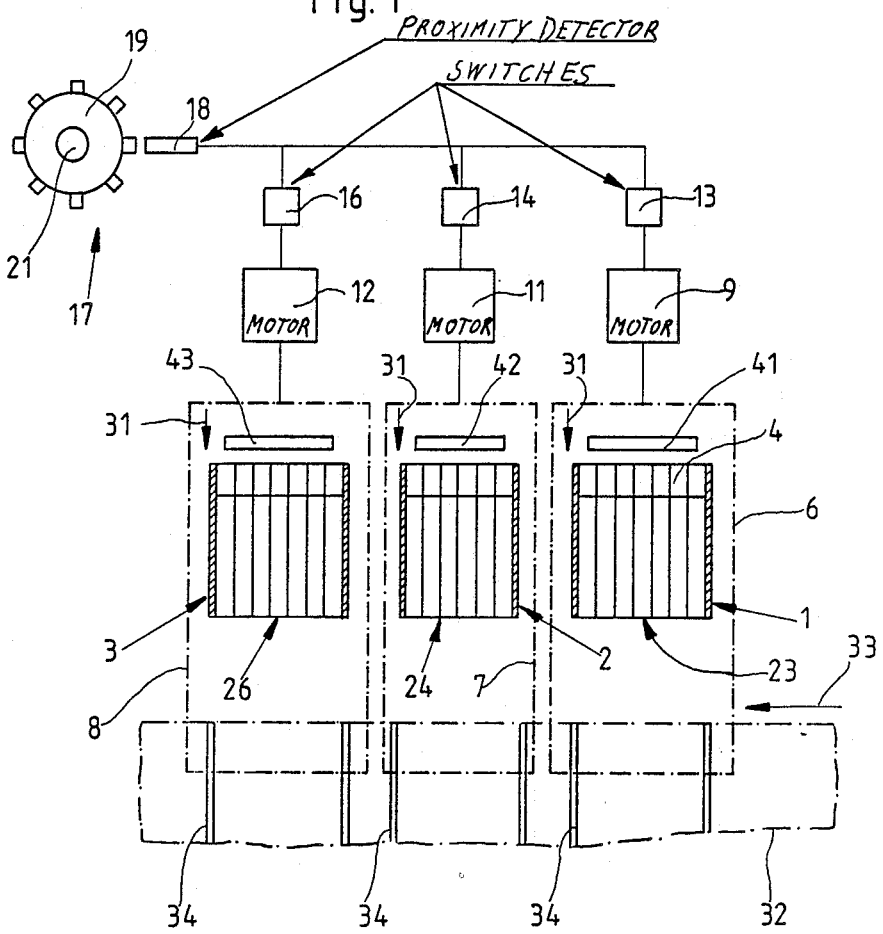
FIG. 1 is a schematic partly plan and partly horizontal sectional view of an apparatus which embodies the invention and is designed to gather blocks of filter cigarettes wherein each row consists of three layers.

FIG. 1 shows a portion of a packing machine for filter cigarettes 4, and more particularly a portion of an apparatus which serves to transfer layers of parallel filter cigarettes from the lower ends of three neighboring ducts 1, 2, 3 into successive receptacles 34 of an endless transporting device 32, such as chain conveyor which is driven in stepwise fashion in the direction of arrow 33. The ducts 1, 2, 3 form part of a magazine which has a total of twenty chutes (seven in each of the ducts 1, 3 and six in the duct 2) serving to permit columns of parallel horizontal filter cigarettes 4 to descend at right angles to their respective axes and at right angles to the plane of FIG. 1.

The opening at the lower end 23 of the duct 1 receives from above successive layers 27 of seven filter cigarettes 4 each, the opening at the lower end 24 of the duct 2 receives from above successive layers 28 of six cigarettes 4 each, and the opening 22 (FIG. 2) at the lower end 26 of the duct 3 receives from above successive layers 29 of seven cigarettes 4 each. The lower ends 23, 24, 26 are disposed next to each other but at different levels, namely the lower end 23 at a level below the lower end 24 and the lower end 24 at a level below the lower end 26. The difference between the neighboring levels equals or approximates the diameter of a filter cigarette 4.

In accordance with a feature of the invention, the means for transferring layers 27, 28, 29 into successive receptacles 34 of the transporting device 32 comprises three discrete endless conveyors 6, 7 and 8, respectively. These conveyors can be driven by discrete prime movers 9, 11 and 12 (shown in the upper part of FIG. 1), and each such prime mover can comprise or constitute an electric motor which continuously drives the respective endless conveyor as soon as it is started by the respective combined starting and arresting unit 13, 14, 16. Each such unit can constitute or comprise an on-off switch for the respective prime mover. The apparatus further comprises means (17) for operating the units 13, 14 and 16 in a predetermined sequence, namely in such a way that the unit 13 starts the prime mover 9 ahead of the prime movers 11 and 12, that the unit 14 starts the prime mover 11 ahead of the prime mover 12, that the unit 16 starts the prime mover 12 subsequent to starting of the prime mover 11, that the unit 13 arrests the prime mover 9 prior to stoppage of the prime movers 11 and 12, that the unit 14 arrests the prime mover 11 prior to stoppage of the prime mover 12, and that the unit 16 arrests the prime mover 12 when the prime movers 9 and 11 are already idle. The operating means 17 comprises a proximity detector 18 having an output connected with the inputs of the units 13, 14 and 16, a timing disc 19 which carries magnets or other suitable activating elements for the proximity detector 18, and a shaft 21 which derives motion from the main prime mover (not shown) of the packing machine and drives the disc 19.

The direction in which each of the endless conveyors 6, 7, 8 transfers successive layers (27, 28, 29) of filter cigarettes 4 from the respective lower end (23, 24, 26) into the registering receptacle 34 of the transporting device 32 is indicated by arrows 31. Thus, the transfer of layers 27 to 29 takes place in a direction at right angles to the direction (arrow 33) of stepwise advancement of the transporting device 32. The receptacles 34 are equidistant from each other (as seen in the direction of arrow 33), the same as the lower ends 23, 24, 26 of the ducts 1, 2 and 3. This ensures that, when a receptacle 34 registers with the lower end 23, the first preceding receptacle 34 registers with the lower end 24 and the second preceding receptacle 34 registers with the lower end 26.

A complete block or array 36 (FIG. 2) of twenty filter cigarettes 4 consists of three layers, namely a lowermost layer 37 (converted layer 27), a median layer 38 (converted layer 28) and an upper layer 39 (converted layer 29). Conversion of (uncompacted) layers 27 into layers 37 takes place during advancement of cigarettes 4 from the lower end 23 of the duct 1 through a condensing or compacting channel while the layer advances toward and into the registering receptalce 34. Two additional condensing channels (one shown in FIG. 2, as at 58) are disposed in register with the lower ends 24 and 26 of the ducts 2 and 3, respectively.

Figure 2:
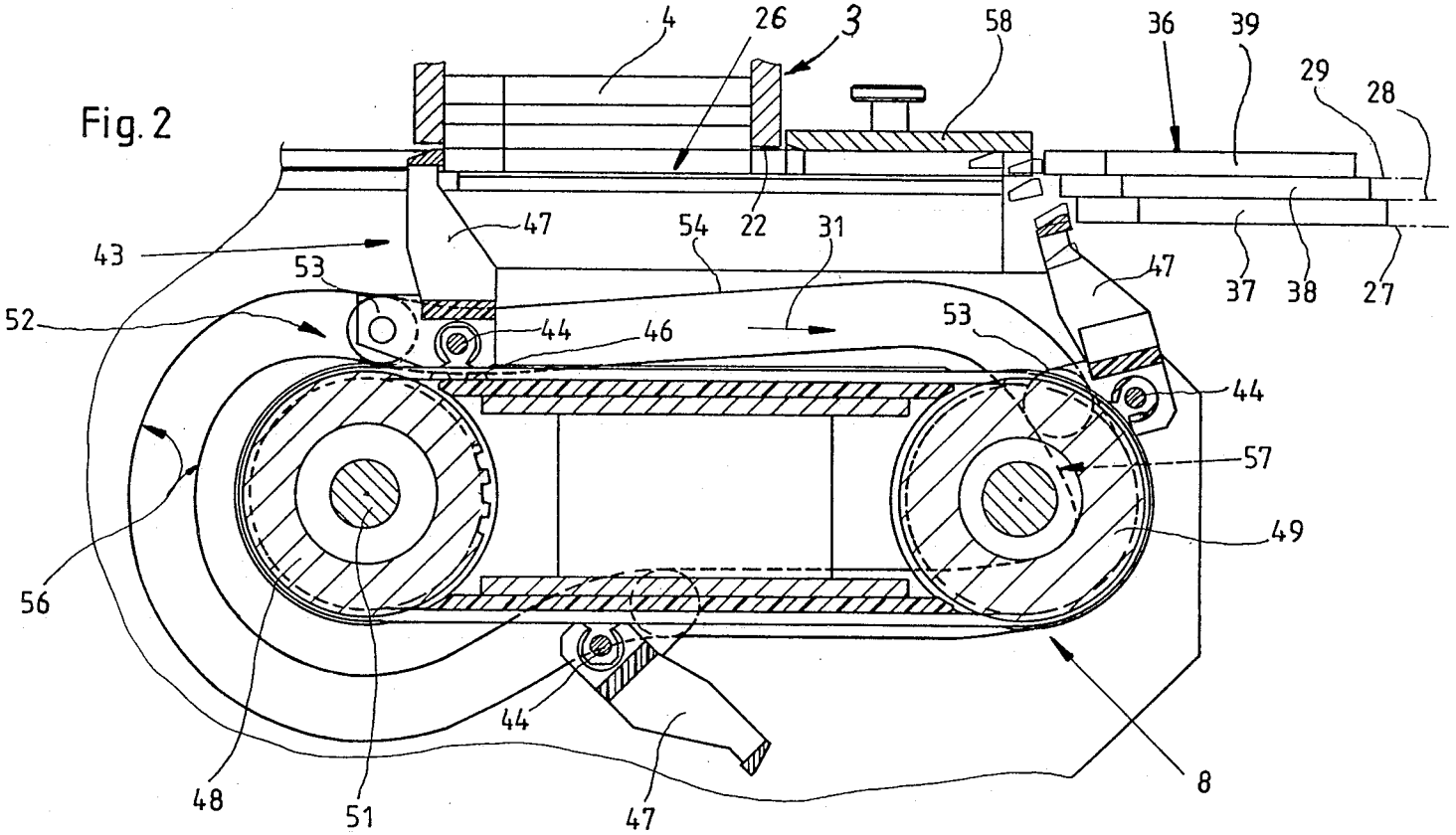
FIG. 2 is an enlarged sectional view substantially as seen in the direction of arrows from the line II—II of FIG. 1.

The endless conveyor 6 of the transferring means is identical with the conveyors 7 and 8 except that each of these conveyors is mounted at a different level, namely at an appropriate distance from the lower ends (23, 24, 26) of the respective ducts 1, 2, 3. FIG. 2 shows the details of the endless conveyor 8 beneath the lower end 26 of the duct 3. This conveyor includes an endless toothed belt 46 which is trained over two toothed pulleys 48, 49 and carries three equidistant parallel coupling pins 44 for discrete pusher-shaped expelling elements 47 of a set (43) of three such expelling elements. The toothed belt of the conveyor 6 carries a set (41) of three expelling elements 47, and the toothed belt of the conveyor 7 carries a set (42) of three expelling elements 47. The expelling elements 47 of the set 41 are active at the level of the lower end 23 of the duct 1, the expelling elements 47 of the set 42 are active at the level of the lower end 24 of the duct 2, and the expelling elements 47 of the set 43 are active at the level of the lower end 26 of the duct 3 (see FIG. 2).

The pulley 48 for the belt 46 of the conveyor 8 of FIG. 2 is driven by a shaft 51 which receives motion from the prime mover 12. This conveyor further comprises means for imparting to the expelling elements 47 a pivotal second movement which is superimposed upon the movement with the belt 46. Such movement imparting means comprises a stationary cam 52 with an endless cam groove 54 and a follower 53 on each expelling element 47. The followers 53 extend into the groove 54 and cause the respective expelling elements 47 to perform pivotal movements with reference to the belt 46 during certain stages of movement of an element 47 in the direction of arrow 31. The groove 54 includes an arcuate section 56 tracked by the follower 53 of that expelling element 47 which is about the engage the rear end faces of a layer 29 of cigarettes 4 for advancement of such layer into and through the condensing or compacting channel 58 and thence into the registering receptacle 34 wherein the converted layer 39 comes to rest on top of the layers 38 and 37 to complete the gathering of a full block or array 36. The section 56 of the groove 54 causes the respective element 47 to pivot in a counterclockwise direction, i.e., to move its layer-engaging portion with reference to the belt 46 counter to the direction (arrow 31) of movement of the corresponding coupling pin 44 with the belt 46 along the substantially straight upper portion of the endless path for the pins 44. Such pins are caused to advance along this portion of their endless path while the corresponding expelling elements 47 advance layers 29 from the lower end 26 of the duct 3 toward and into the registering receptacles 34.

The cam groove 54 further includes a straight second section 57 which is located downstream of the arcuate section 56 and is tracked by a follower 53 when the respective expelling element 47 has completed the transfer of a converted layer 37 into the registering receptacle 34. The cam groove section 57 causes the expelling elements 47 to pivot relative to the belt 46 in such a way that the layer-engaging portion of the element 47 descends beneath the freshly transferred converted layer 39 and can bypass the corresponding receptacle 34 while moving along the right-hand end turn (defined by the pulley 49) for the belt 46 of the endless conveyor 8.

The construction of the conveyors 6 and 7 is or can be identical with that of the just described conveyor 8 except, of course, that the conveyors 6 and 7 are installed at different levels.

The operation is as follows:

When the packing machine is idle, a discrete empty receptacle 34 is aligned with the lower end (23, 24, 26) of each of the three ducts 1, 2 and 3. If the unit 13 receives a signal to start the prime mover 9, the conveyor 6 is set in motion while the conveyors 7 and 8 remain idle. One expelling element 47 on the belt 46 of the conveyor 6 transfers the lowermost layer 27 from the lower end 23 of the duct 1, through the respective condensing or compacting channel (with attendant conversion of the layer 27 into a layer 37) and onto the bottom panel of the registering receptacle 34 so that the latter then confines one-third of a full block or array 36. The layer-engaging portion of the expelling element 47 on the belt of the conveyor 6 gently engages the rear ends of filter cigarettes 4 which form the layer 27 because, at the time the respective expelling element 47 is about to engage the cigarettes, it pivots rearwardly with reference to the belt 46 so that its speed of movement in the direction of arrow 31 is less than that of the respective pivot pin 44. The pivoting is due to the fact that, at such time, the follower 53 of the expelling element 47 which is about to reach the cigarettes 4 of the layer 27 advances along the arcuate section 56 of the cam groove 54. The initial stage of movement of a follower 53 along the section 56 of the respective cam groove 54 entails a forward pivoting of the respective element 47 but the latter thereupon pivots with reference to the belt 46 counter to the direction of arrow 31 to thus soften the impact upon the rear ends of cigarettes 4 which form the layer 27. The expelling element 47 thereupon advances in the direction of arrow 31 at the full speed of the belt 46 until its follower 53 reaches the cam groove section 57 adjacent the respective pulley 49. This again causes the expelling element 47 to pivot with reference to the belt 46 in a counterclockwise direction (as seen in FIG. 2) so that its layer-engaging portion descends below the fully transferred layer 37. This can be seen in FIG. 2 which shows several intermediate positions of the layer-engaging portion of the element 47 on the belt 46 of the conveyor 8 beneath the channel 58.

When the transfer of the condensed or converted layer 37 into the registering receptacle 34 is completed, the transporting device 32 is caused to advance by a step so that the receptacle 34 with the layer 37 therein moves to a position of alignment with the lower end 24 of the duct 2. Such movement of the transporting device 32 induces the detector 18 to cause the unit 14 to start the prime mover 11 for the belt of the conveyor 7 while the conveyor 8 continues to remain idle. One expelling element 47 on the belt of the conveyor 7 then transfers the lowermost layer 28 into the corresponding condensing or compacting channel and the thus obtained condensed or converted layer 38 is then introduced into the registering receptacle 34 on top of the layer 37, i.e., the receptacle then contains two-thirds of a full block or array 36. At the same time, the receptacle 34 which then registers with the lower end 23 of the duct 1 receives a layer 37 to start the building of a fresh block 36.

The transporting device 32 thereupon advances its receptacles 34 by a step so that the receptacle 34 with the layers 37 and 38 therein moves to a position of alignment with the lower end 26 of the duct 3, a receptacle 34 containing a layer 37 is aligned with the lower end 24 of the duct 2, and an empty receptacle 34 is aligned with the lower end 23 of the duct 1. Each of these receptacles then receives a layer because all three prime movers 9, 11 and 12 are in operation. The receptacle which is aligned with the lower end 26 receives a layer 39 so that it then contains a fully assembled block or array 36 which is ready for draping into one or more blanks to be converted into a cigarette pack. The receptacle 34 which is aligned with the lower end 24 receives a layer 38, and the receptacle which is aligned with the lower end 23 receives a layer 37.

The above completes the starting stage of operation of the apparatus, and the apparatus thereupon gathers full blocks or arrays 36 in successive receptacles 34 in stepwise fashion so that each receptacle which advances to the left beyond the duct 3 of FIG. 1 contains a block 36 which is ready for packing. The conveyors 6–8 are driven continuously and in synchronism so that one expelling element 47 of each of these conveyors is ready to transfer a layer (27, 28, 29) as soon as the receptacles 34 come to a halt between successive stepwise movements of the transporting device 32.

If the detector 18 is caused to transmit a stop signal, such signal is first transmitted to the unit 13 which stops the prime mover 9 while the prime movers 11 and 12 remain operative. This ensures that the receptacle 34 which then registers with the lower end 23 of the duct 1 remains empty but the conveyors 7 and 8 transfer discrete layers 38 and 39, respectively. When the transporting device 32 is set in motion again, the prime mover 11 is arrested by the unit 14 but the prime mover 12 remains operative so that the receptacle 34 which then registers with the lower end 26 receives a layer 39 to complete the gathering of a full block 36 therein. The receptacles 34 which are then aligned with the lower ends 23 and 24 remain empty, and the prime mover 12 is arrested by the unit 16 when the transporting device 32 is set in motion again so that the three receptacles which then register with the lower ends 23, 24, 26 are empty and the apparatus is ready to proceed with the gathering of fresh blocks 36 as soon as the unit 13 receives a start signal to activate the prime mover 9.

The aforedescribed mode of operation of the improved apparatus ensures that each receptacle 34 which is advanced beyond the duct 3 contains a complete block 36 as well as that an empty receptacle 34 is adjacent each of the three lower ends 23, 24, 26 when the apparatus is idle.

The number of endless conveyors depends upon the number of layers of rod-shaped articles in a block or array.

An advantage of discrete prime movers (9, 11, 12) for the endless conveyors (6, 7, 8) is that this enhances the versatility and flexability of the apparatus. Moreover, the operation of the apparatus is quieter and the apparatus comprises fewer parts because there is no need for the provision of complex motion transmitting power trains between a single prime mover and several endless conveyors. In addition, it has been found that the output of such apparatus is higher than that of an apparatus with a common prime mover for two or more discrete endless conveyors, i.e., the number of layers of rod-shaped articles which are transferred per unit of time is higher. Still further, the wear upon the parts of the apparatus is less pronounced because each endless conveyor is in operation only when it is called upon to transfer layers of rod-shaped articles in the axial direction of such articles from the respective duct into a receptacle 34.

The provision of the aforediscussed control means including the units 13, 14, 16 and the operating means 17 renders it possible to reduce the number of rejects during certain critical stages of operation of the packing machine which embodies the improved apparatus, particularly during starting and during stoppage or running out of the packing machine. The number of rejects is normally higher during starting and during stoppage, and the control means including the parts 13, 14, 16 and 17 ensures that the number of rejects during these stages is not increased by delivering to the packing station receptacles 34 which do not contain complete arrays or blocks 36. In other words, a receptacle 34 cannot receive a layer 38 or 39 if it does not contain a layer 37, and a receptacle cannot receive a layer 39 if it does not contain a layer 37 and a layer 38 on top of the layer 37. Inversely, a receptacle 34 which advances beyond the duct 3 invariably contains three superimposed layers 37, 38, 39, i.e., a complete block or array 36 which is ready for draping into one or more blanks of paper, cardboard, metallic foil or plastic. This is due to the fact that, once the gathering of a block has begun, such gathering is invariably completed since the prime movers 9, 11 and 12 are arrested one after the other in the same sequence in which they are started, i.e., the prime mover 9 ahead of the prime movers 11, 12 and the prime mover 11 ahead of the prime mover 12.

The cams 52 and the followers 53 ensure that the cigarettes 4 are treated gently during the initial stage of shifting of each layer from the lower end 23, 24 or 36 toward a receptacle 34 as well as that each transferring step is completed without damage to those ends of the cigarettes which were contacted by the respective expelling elements 47 during the last stages of their transfer into the respective receptacles.

All in all, the improved apparatus contributes to higher output of packing machines for cigarettes or other rod-shaped articles which are to be transferred in the form of layers consisting of parallel articles, especially in the form of layers which are to be stacked on top of each other.

The apparatus of the present invention can be used in packing machines of the type disclosed in copending patent application Ser. No. 207,294 filed June 15, 1988, now U.S. Pat. No. 4,866,912.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for transferring layers of elongated parallel rod-shaped articles having predetermined diameters, particularly rod-shaped articles of the tobacco processing industry, comprising a magazine including a series of neighboring article-containing ducts having lower ends arranged to discharge a succession of layers, the lower ends of said ducts being disposed at different levels with a mutual spacing matching or approximating a predetermined diameter; a transporting device having a series of receptacles and being operative to place successive receptacles of said series into register with the lower ends of successive ducts of said series of ducts; means for transferring layers from the lower ends of said ducts into registering receptacles of said transporting device, comprising an endless conveyor for each of said ducts and at least one expelling element provided on each conveyor and operative to move a layer of articles from said lower end of the respective duct into the registering receptacle in the longitudinal direction of the articles, said transferring means further comprising a discrete prime mover for each of said endless conveyors and discrete starting and arresting means for each of said prime movers; and means for operating said starting and arresting means so as to start said conveyors in a predetermined sequence and to arrest said conveyors in the same sequence.

2. The apparatus of claim 1, wherein each of said prime movers comprises means for continuously driving the respective endless conveyor.

3. The apparatus of claim 1, wherein said transferring means comprises a plurality of equidistant expelling elements on each of said conveyors.

4. The apparatus of claim 3, wherein said transferring means further comprises means for movably coupling said expelling elements to the respective conveyors.

5. The apparatus of claim 1, wherein each endless conveyor defines for and moves the respective at least one expelling element along an endless first path and said transferring means further comprises means for movably coupling each expelling element to the respective endless conveyor, and means for imparting to each expelling element a movement along a second path with reference to the respective endless conveyor in response to movement of the respective at least one expelling element along the respective first path.

6. The apparatus of claim 5, wherein said movement imparting means includes stationary cams which define said second paths, and follower means provided on said expelling elements and tracing the respective cams.

7. The apparatus of claim 6, wherein each cam has an endless cam groove for the respective follower means.

8. The apparatus of claim 6, wherein each first path includes a predetermined portion along which the respective at least one expelling element is moved in a predetermined direction by the respective endless conveyor during transfer of a layer from the lower end of the corresponding duct into the registering receptacle, each cam including a portion which is tracked by the respective follower means while the corresponding at least one expelling element is moved along said predetermined portion of the respective first path and which causes the corresponding at lest one expelling element to move with reference to the respective endless conveyor counter to said predetermined direction.

9. The apparatus of claim 8, wherein each of said coupling means includes means for pivotably coupling the respective at least one expellnig element to the corresponding endless conveyor.

10. The apparatus of claim 8, wherein each first path includes a second portion which follows the respective predetermined portion and each cam includes a second portion which is tracked by the respective follower means while the corresponding at least one expellnig element is moved along the second portion of the respective first path and which causes the corresponding at least one expelling element to become disengaged from the transferred layer.

11. The apparatus of claim 10, wherein said second portion of each first path is arcuate and said second portion of each cam is substantially straight.

* * * * *